US009233381B2

(12) United States Patent
Motozaki et al.

(10) Patent No.: US 9,233,381 B2
(45) Date of Patent: Jan. 12, 2016

(54) ROTARY ATOMIZER HEAD OF ELECTROSTATIC PAINT APPLICATOR

(75) Inventors: Masahiko Motozaki, Yokohama (JP); Ryuji Tani, Narashino (JP)

(73) Assignee: Ransburg Industrial Finishing K.K., Kanagawa (JP)

( * ) Notice: Subject to any disclaimer, the term of this patent is extended or adjusted under 35 U.S.C. 154(b) by 527 days.

(21) Appl. No.: 13/541,858

(22) Filed: Jul. 5, 2012

(65) Prior Publication Data

US 2013/0026258 A1 Jan. 31, 2013

Related U.S. Application Data

(63) Continuation of application No. PCT/JP2011/050136, filed on Jan. 6, 2011.

(30) Foreign Application Priority Data

Jan. 6, 2010 (JP) ..... 2010-001542

(51) Int. Cl.
*B05B 3/02* (2006.01)
*B05B 5/04* (2006.01)
*B05B 3/10* (2006.01)

(52) U.S. Cl.
CPC ..... *B05B 5/0407* (2013.01); *B05B 3/1014* (2013.01); *B05B 5/0403* (2013.01)

(58) Field of Classification Search
CPC .... B05B 5/0407; B05B 5/0403; B05B 3/1014
USPC ..... 239/222.11, 222.15, 223, 224, 239/380–383, 700, 703
See application file for complete search history.

(56) References Cited

U.S. PATENT DOCUMENTS 5,803,372 A * 9/1998 Weinstein et al. ..... 239/703
5,813,608 A * 9/1998 Yoshioka et al. ..... 239/110
5,820,036 A * 10/1998 Saito ..... 239/703

(Continued)

FOREIGN PATENT DOCUMENTS

JP 09-234393 9/1997
JP H09-271696 A 10/1997

(Continued)

OTHER PUBLICATIONS

Extended European Search Report issued in corresponding European Patent Application No. 11731827.9 dated Aug. 20, 2013 (4 pages).

(Continued)

*Primary Examiner* — Jason Boeckmann
(74) *Attorney, Agent, or Firm* — Kilyk & Bowersox, P.L.L.C.

(57) ABSTRACT

A rotary atomizer head 1 with a bell-shaped atomizer head body 2 and a functional member 4 removably attachable thereto, which can be more easily and reliably positioned, and cleaned. The functional member 4 has a front wall 12 that has paint outlets 24, a sidewall 14 of the paint space S extending continuously in a circumferential direction, and a plurality of legs 16 having claws 16*a*, which engage with a circumferential groove 18 formed in a peripheral wall 8 of a central recess 6 of the atomizer head body 2. The peripheral wall 8 of central recess 6 has an inclined wall. The sidewall 14 has an outer circumferential surface 14*a* and an inner circumferential surface 14*b*, wherein the peripheral wall 8 and outer circumferential surface 14*a* have complementary configurations.

11 Claims, 15 Drawing Sheets

(56) References Cited

U.S. PATENT DOCUMENTS

| | | | | |
|---|---|---|---|---|
| 5,894,993 | A * | 4/1999 | Takayama et al. | 239/112 |
| 5,897,060 | A * | 4/1999 | Kon et al. | 239/223 |
| 6,076,751 | A * | 6/2000 | Austin et al. | 239/700 |
| 6,189,804 | B1 | 2/2001 | Vetter et al. | |
| 6,360,962 | B2 | 3/2002 | Vetter et al. | |
| 6,557,781 | B2 * | 5/2003 | Kon | 239/224 |
| 7,017,835 | B2 | 3/2006 | Vetter et al. | |
| 2003/0010841 | A1 * | 1/2003 | Kon | 239/224 |
| 2003/0080221 | A1 * | 5/2003 | Seitz | 239/700 |
| 2007/0240645 | A1 * | 10/2007 | Nomura et al. | 118/719 |
| 2007/0290081 | A1 * | 12/2007 | Murai et al. | 239/703 |
| 2009/0308949 | A1 * | 12/2009 | Yamasaki et al. | 239/223 |

FOREIGN PATENT DOCUMENTS

| | | | | |
|---|---|---|---|---|
| JP | 2001-104841 | | 4/2001 | |
| JP | 2002-186883 | A | 7/2002 | |
| JP | 2002186883 | A * | 7/2002 | B05B 3/10 |
| JP | 2002-224593 | | 8/2002 | |
| JP | 2005-118710 | | 5/2005 | |
| JP | 2009-119402 | | 6/2009 | |

OTHER PUBLICATIONS

International Search Report issued in corresponding International Patent Application No. PCT/JP2011/050136 dated Mar. 15, 2011 (1 page).

* cited by examiner

ROTARY ATOMIZER HEAD OF ELECTROSTATIC PAINT APPLICATOR

The present application is a continuation of International Patent Application No. PCT/JP2011/050136, filed Jan. 6, 2011, which claims priority from Japanese Patent Application No. 2010-001542, filed Jan. 6, 2010.

FIELD OF THE INVENTION

The present invention relates to an electrostatic paint applicator and, more particularly, to a rotary atomizer head to be attached to the electrostatic paint applicator.

BACKGROUND ART

Nowadays where electrostatic paint applicators are in widespread use, such machines having a rotary atomizer head are widely used in the field of car body coating, for example. These paint applicators are called rotary-atomization-type paint applicators. As disclosed in Patent Documents 1 to 8, the rotary atomizer head is an assembly of an atomizer head body and a functional member disposed in a central portion of the atomizer head body. Paint is supplied to the rotary atomizer head through a feed tube, and atomized by the rotary atomizer head that rotates at a high speed. For this intended role of the rotary atomizer head, it is required to have a highly precise rotational balance.

For internal cleaning of the rotary atomizer head, there have been developed techniques for easier disassembling and reassembling of the rotary atomizer head. Patent Document 1 discloses a rotary atomizer head that is configured to attach the functional member to the atomizer head body by access from behind. It is proposed in Patent Document 1 to form a paint outlet in the atomizer head body and to make a paint chamber of the rotary atomizer head, which is a chamber for receiving paint supplied from a feed tube, by cooperation of the atomizer head body and the functional member attached to the atomizer head body from behind.

Patent Documents 2 et sec. disclose rotary atomizer heads configured to attach a functional member called a "hub member" to the atomizer head body by access from its front face. Patent Document 2 proposes to fix the hub member in a central recess of the atomizer head body via an elastic ring. More specifically, the rotary atomizer head disclosed in Patent Document 2 has a circumferential groove (first circumferential groove) formed in a circumferential wall surface of the central recess of the atomizer head body and another circumferential groove (second circumferential groove) formed in a circumferential surface of the hub member. By laying the elastic ring in the first and second circumferential grooves to be commonly grasped by these grooves, the hub member is removably fixed to the atomizer head body.

With the rotary atomizer head disclosed in Patent Document 2, the hub member can be easily removed from the atomizer head body for the purpose of cleaning, and attached again to the atomizer head body after completion of the cleaning.

Patent Document 3 discloses another existing rotary atomizer head that can be disassembled and reassembled. The rotary atomizer head disclosed in Patent Document 3 has a step formed at the front end of the peripheral wall of the central recess of the atomizer head body, and a disc-shaped hub member fittingly engages with this step. More particularly, the disc-shaped hub member has elasticity and flexibility owing to natures of its shape and material, and it can get in fitting engagement with the step of the atomizer head body with the elasticity and flexibility. Further, a retaining circumferential ridge is formed on the circumferential surface of the step of the atomizer head, or the circumferential surface of the step is tapered to decrease its diameter forward, as a measure for preventing the hub member from being disengaged forward of the atomizer head body. Further, Patent Document 3 discloses a rotary atomizer head having a spoon-cut groove formed in the bottom of the central recess of the atomizer head body and having an inclined wall surface extending continuously from the spoon-cut groove and enlarging its diameter gradually forward. The above-mentioned disc-shaped hub member has a plurality of paint outlets formed to align concentrically in the outer circumference thereof. The paint outlets extend tangentially to the inclined wall surface.

Patent Document 4 proposes to attach permanent magnets on a disc-shaped hub member and an atomizer head body for receiving the hub member, such that the disc-shaped hub member can be fixed to the atomizer head body with the attraction of the permanent magnets.

Patent Document 5 proposes to use a disc-shaped hub member having a number of legs, which can be removably fixed to the atomizer head body by engagement of free ends of the legs with a circumferential groove in the central recess of the atomizer head body in order to removably secure the hub member to the atomizer head body. In addition to this, Patent Document 5 proposes to provide a clearance between the outer circumference of the disc-shaped hub member and the atomizer head body to use it as a paint passageway.

One problem of the rotary atomizer head disclosed in Patent Document 2, which relies solely upon a resistance force produced by the elasticity of the elastic ring for fixing the hub member to the atomizer head body. Another problem of this rotary atomizer head, which relies on the elasticity of the elastic member for fixing the hub member in position, is a difficulty for a user to be sure that the hub member has taken its proper position when he should attach it to the atomizer head body. Still another problem of this atomizer head is that the elastic ring deforms when the rotary atomizer head rotates at a high speed, and thereby degrades in its sealing performance.

To interpose the elastic ring between the atomizer head body and hub member means that a relatively large clearance exists between the atomizer head body and hub member. Therefore, the technique proposed by Patent Document 2 can be considered to admit inrush of paint through the clearance. When paint should be changed to another color, the rotary atomizer head needs internal cleaning without being disassembled. However, it is difficult to remove paint having entered the clearance between the atomizer head body and the hub member by the internal cleaning. Because of this and other reasons, the invention disclosed in Patent Document 2 has not yet been put into practice.

Patent Document 3 proposes to put the disc-shaped hub member in fitting engagement with the step portion of the atomizer head body and to form the retaining circumferential ridge on the circumferential surface of the step portion of the atomizer head, or to taper the circumferential surface of the step to decrease its diameter forward, as a measure for preventing the hub member from being disengaged forward of the atomizer head body. This invention of Patent Document 3 has not yet been put into practice as well.

Patent Document 4 proposes to secure the disc-shaped hub member and atomizer head body to each other by the attraction force of permanent magnets. Because of this structure, this technology is disadvantageous in that the materials of the disc-shaped hub member and the atomizer head body are limited to nonmagnetic ones (aluminum).

In Patent Document 5, it is disclosed that the disc-shaped hub member is fixed by engagement of the legs of the hub member with the circumferential groove formed in the peripheral wall of the central recess of the atomizer head body and that paint outlets are formed in each interval between every adjacent legs in the clearance between the outer circumference of the disc-shaped hub member and the peripheral wall of the central recess. Therefore, when the rotary atomizer head is cleaned with a cleaning liquid supplied to the rotary atomizer head, paint having adhered to the circumferential groove and legs will remain unremoved. Because of this problem among others, Patent Document 5 explains in detail how to remove the hub member from the atomizer head body when the atomizer head should be disassembled for cleaning.

PRIOR ART LITERATURE

Patent Documents

[Patent Document 1]
JP Patent Laid-Open Publication No. 2005-118710
[Patent Document 2]
JP Patent Laid-Open Publication No. hei 9-234393
[Patent Document 3]
JP Patent Laid-Open Publication No. 2001-104841
[Patent Document 4]
JP Patent Laid-Open Publication No. 2009-119402
[Patent Document 5]
JP Patent Laid-Open Publication No. 2002-224593
[Patent Document 6]
U.S. Pat. No. 6,189,804 B1
[Patent Document 7]
U.S. Pat. No. 6,360,962 B2
[Patent Document 8]
U.S. Pat. No. 7,017,835 B2

Disclosure of the Invention

An object of the present invention is to provide a rotary atomizer head for an electrostatic paint applicator, which not only can be cleaned by disassembly but also can be cleaned by internal cleaning without disassembly for changing paint of a color to one of another color.

Another object of the invention is to provide a rotary atomizer head that enables a user to ascertain positioning of a functional member and can alleviate the problem of residual paint upon internal cleaning.

Still another object of the invention is to provide a rotary atomizer head improved in efficiency of internal cleaning.

Yet another object of the invention is to provide a rotary atomizer head for an electrostatic paint applicator, which can suppress bubbles developing in the paint applied for coating an object.

These objects of the invention are attained by providing a rotary atomizer head (1) for an electrostatic paint applicator, having a paint space (S) for receiving paint supplied from a paint feed tube and a spoon-cut groove (30) formed in the bottom surface of the paint space (S), comprising:

a bell-shaped atomizer head body (2), and a functional member (4) made of a synthetic resin, which is accessible from a front face of the atomizer head body (2) into a central recess (6) of the atomizer head body (2), the functional member (4) being removably disposed in the central recess (6) of the atomizer head body (2), wherein the functional member (4) includes: a sidewall extending continuously in a circumferential direction (14); a plurality of legs (16) extending rearward from a rear end of the sidewall (14) in circumferential alignment at intervals from each other; and a claw (16*a*) provided at a free end of each leg (16) to engage with a circumferential groove (18) formed in a peripheral wall (8) of the central recess (6) of the atomizer head body (2);

wherein the peripheral wall (8) of the central recess (6) of the atomizer head body (2) gradually increases forward in diameter by an angle of inclination (θ);

wherein the circumferentially continuous sidewall (14) of the functional member (4) has an outer circumferential surface (14*a*) having a complementary configuration with the peripheral wall (8) of the central recess (6), and the outer circumferential surface (14*a*) of the sidewall (14) of the functional member is substantially in contact with the peripheral wall (8) of the central recess (6);

wherein the circumferentially continuous sidewall (14) of the functional member (4) has an inner circumferential surface (14*b*) contiguous to the spoon-cut groove (30);

wherein the functional member (4) has a plurality of paint outlets (24) formed at circumferential intervals to communicate with the paint space (S); and wherein the paint outlets (24) are contiguous to the inner circumferential surface (14*b*) of the sidewall of the functional member (4).

Since the outer circumferential surface (14*a*) of the functional member (4) is substantially in contact with the peripheral wall (8) of the central recess (6) over the entire longitudinal area thereof, paint cannot easily flow onto the outer circumferential surface (14*a*) of the functional member (4). Further, since the outer circumferential surface (14*a*) of the functional member (4) and peripheral wall (8) of the central recess (6) are gradually expanded forward in diameter, even if paint enters into between the functional member (4) and peripheral wall (8) of the central recess (6), it is centrifugally ejected to outside. Therefore, since it is thus possible to prevent paint from going around to between the outer circumferential surface (14*a*) of the functional member (4) and peripheral wall (8) of the central recess (6), the elastic ring disclosed in Patent Document 2 is not required for the present invention.

The spoon-cut groove (30) may be formed in the synthetic resin-made functional member or may be formed in the atomizer head body (2). In case the spoon-cut groove (30) is to be formed in the atomizer head body (2), it is preferable to employ the following specific configuration. That is, a circumferential projection (20) projecting rearward is formed radially inside the plurality of legs (16) of the functional member (4), while the atomizer head body (2) has a circumferential seat (22) formed around a through-hole (10) through which the atomizer head body (2) receives a paint feed tube formed in the central portion of the atomizer head body (2). Thus, the spoon-cut groove (30) is formed in the circumferential seat (22) to extend in the circumferential direction coaxially with the through-hole (10). It is recommended to configure the circumferential projection (20) of the functional member (4) to sit on the outer circumferential portion of the circumferential seat (22) of the atomizer head body (2), and at the same time, to abut against the outer circumferential surface of the circumferential seat (22).

According to the above-mentioned embodiment, the functional member (4) can be removably fixed to the atomizer head body (2) with the claws (16*a*) formed at the distal ends of the legs (16) of the functional member (4). In addition, by configuring the circumferential projection (20) positioned inside the legs (16) of the functional member (4) not only to sit on the circumference of the circumferential seat (22) of the atomizer head body (2) but also to be in abutment with the circumference of the circumferential seat (22) of the atomizer head body (2), it is possible to improve the supporting rigidity of the fixing structure by the legs of the functional member (4) removably attached to the atomizer head body (2). Further to the above, seating the circumferential projection (20) of the functional member (4) onto the circumferential seat (22) of the atomizer head body (2) leads to easier positioning of the functional member (4) relative to the atomizer head body (2) and enhances reliability of the positioning.

The other objects and advantages of the present invention will become apparent from the detailed description of preferred embodiments that follows.

PARTIAL LIST OF REFERENCE NUMERALS

Figure 1:
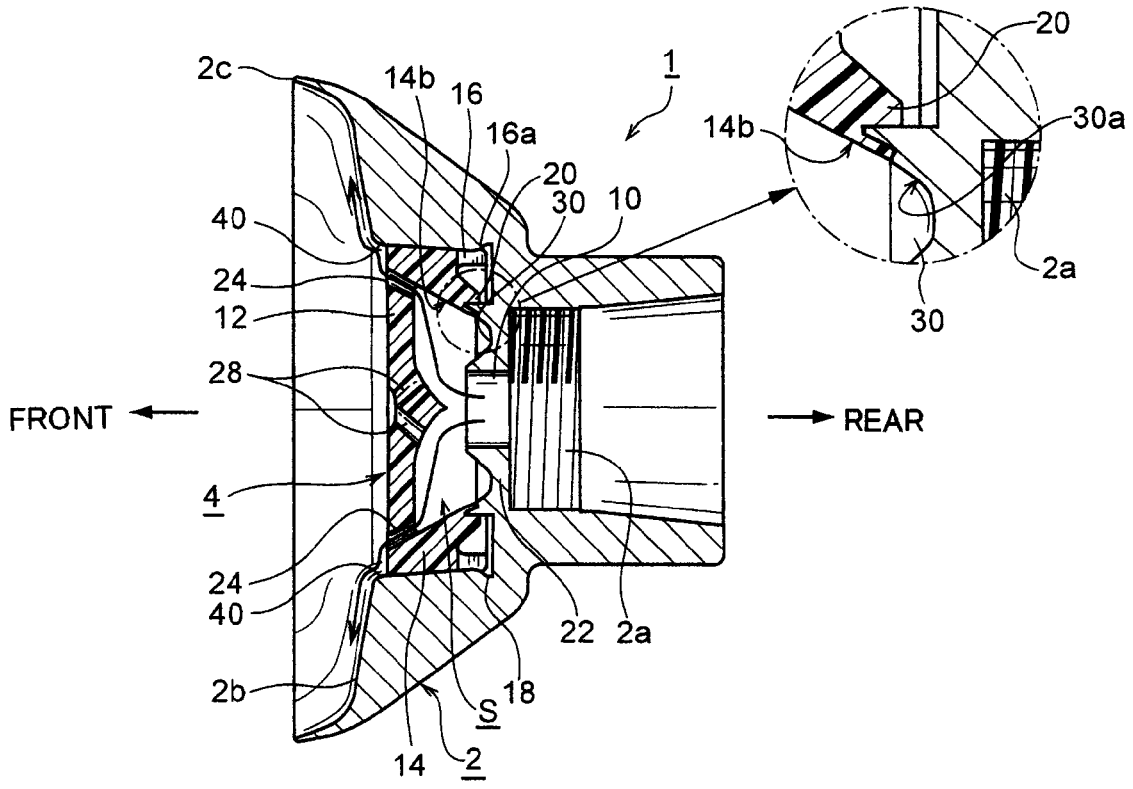
FIG. 1 is a cross-sectional view of a rotary atomizer head according to a first embodiment of the present invention.

1 Rotary atomizer head
2 Atomizer head body
2*b* Inner circumferential surface
2*c* Outer circumferential surface
4 Functional member
6 Central recess of atomizer head body
8 Peripheral wall of central recess
10 Through-hole formed in bottom of atomizer head body
12 Front wall of functional member
14 Side wall of functional member
14*a* Outer circumferential surface of sidewall of functional member
14*b* Inner circumferential surface of sidewall of functional member
16 Legs of functional member
16*a* Claws of legs
18 Circumferential groove for receiving claws of legs of functional member
20 Circumferential projection projecting rearward of functional member
22 Circumferential seat at bottom of atomizer head body
24 Paint outlets formed in outer circumferential portion of front wall of functional member
30 Spoon-cut groove formed around through-hole formed in bottom of atomizer head body

DETAILED DESCRIPTION OF THE INVENTION

Preferred embodiments of the present invention are explained below in detail with reference to the accompanying drawings.

First Embodiment

FIGS. 1 to 6

FIG. 1 shows the rotary atomizer head removed from a rotary atomization type electrostatic paint applicator. Similarly to the rotary atomizer head disclosed for example in Patent Document 2 (JP Patent Laid-Open Publication No. hei 9-234393), the rotary atomizer head 1 shown here is an assembly of an atomizer head body 2 and a functional member 4 disposed in the central portion of the atomizer head body 2. The functional member 4 is removably attached to the atomizer head body 2.

As disclosed in Patent Documents 1 and 2 for example, the rear end portion of the atomizer head body 2 is threaded in its inner surface to form a female an internal thread (as indicated with a numeral 2*a*) into which a rotating shaft of an air motor (not shown) is to be screwed. The internal thread 2*a* has a central axis common to the rotary atomizer head 1. The rotary atomizer head 1 is driven to rotate by the air motor similarly to the conventional rotary atomizer heads.

As described in detail in Patent Document 2, the rotating shaft of the air motor is hollow, and a paint feed tube is inserted in the rotating shaft. That is, paint is supplied to the central portion of the rotary atomizer head 1 through the paint feed tube. Further, the space between the outer circumferential surface of the paint feed tube and inner circumferential surface of the rotating shaft serves as a path for a cleaning liquid (typically a thinner). The rotary atomizer head 1 is washed with the cleaning liquid supplied through the cleaning liquid path. Since Patent Document 3 provides detailed explanation about supply of paint and cleaning liquid, the present specification omits its explanation by invoking the description of the same document.

Figure 2:
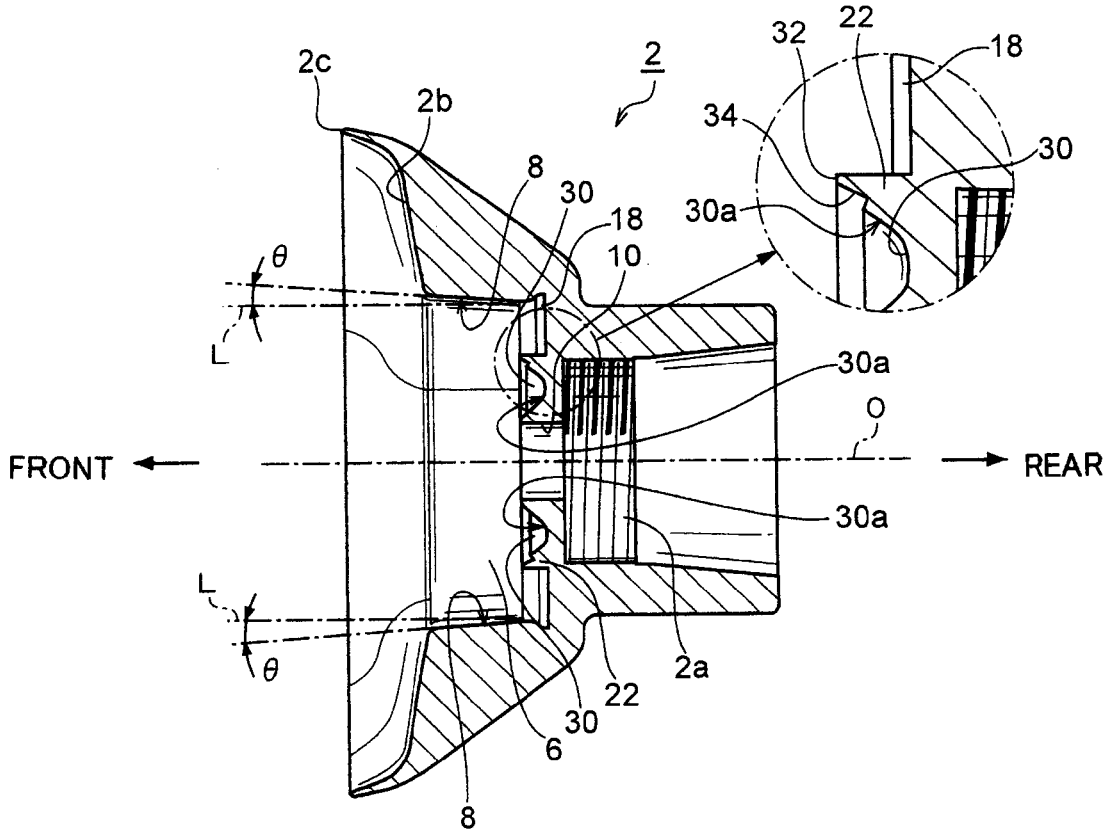
FIG. 2 is a cross-sectional view of an atomizer head body that is a part of the rotary atomizer head according to the first embodiment.

FIG. 2 illustrates the atomizer head body 2 from which the functional member 4 has been removed. The atomizer head body 2 shown in FIG. 2 is formed by molding an electrically conductive material such as aluminum alloy, stainless steel alloy or hard resin. It is shaped in the form of a bell similarly to conventional ones. That is, the atomizer head body 2 has an inner circumferential surface 2*b* which is open forward and contiguous to an outer circumferential edge 2*c* of the atomizer head body 2. By applying a high voltage to the atomizer head body 2, paint can be charged electrostatically.

In the central portion of the inner circumferential surface 2*b* of the atomizer head body 2, a central recess 6 opening forward is formed (FIG. 2). The central recess 6 has a form that is generally cylindrical but enlarged forward in diameter. More particularly, the central recess 6 has a peripheral wall 8 inclined by an angle of θ with respect to a line L parallel to an axis of rotation O of the rotary atomizer head 1 in its cross-sectional view. In the central portion of the central recess 6, a through-hole 10 is formed, which is circular in cross section. This through-hole 10 is to receive a paint feed tube (not shown). The through-hole 10 is coaxial with the axis of rotation of the rotary atomizer head 1 (atomizer head body 2).

Figure 3:
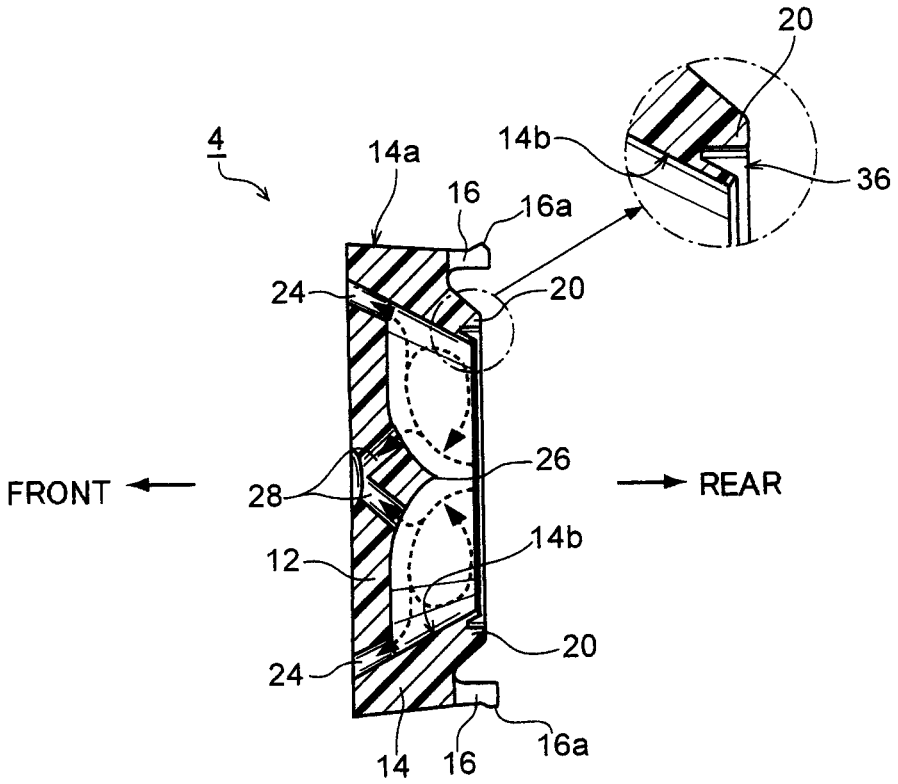
FIG. 3 is a cross-sectional view of a functional member that is a part of the rotary atomizer head according to the first embodiment.
Figure 4:
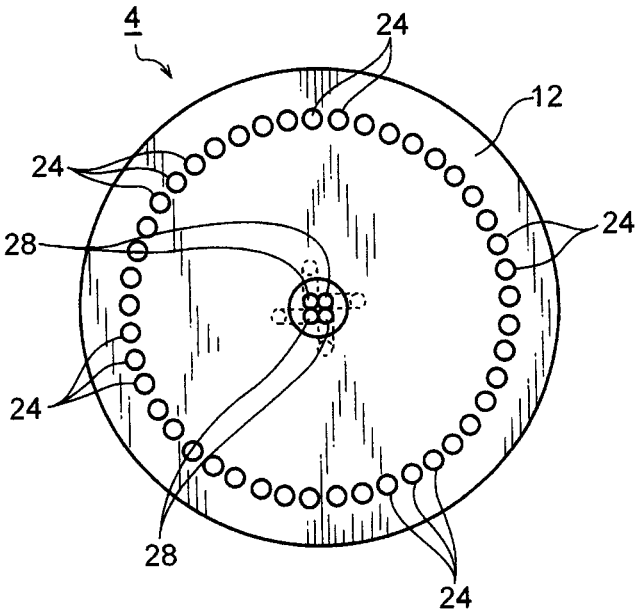
FIG. 4 is a front elevation of the functional member shown in FIG. 3.
Figure 5:
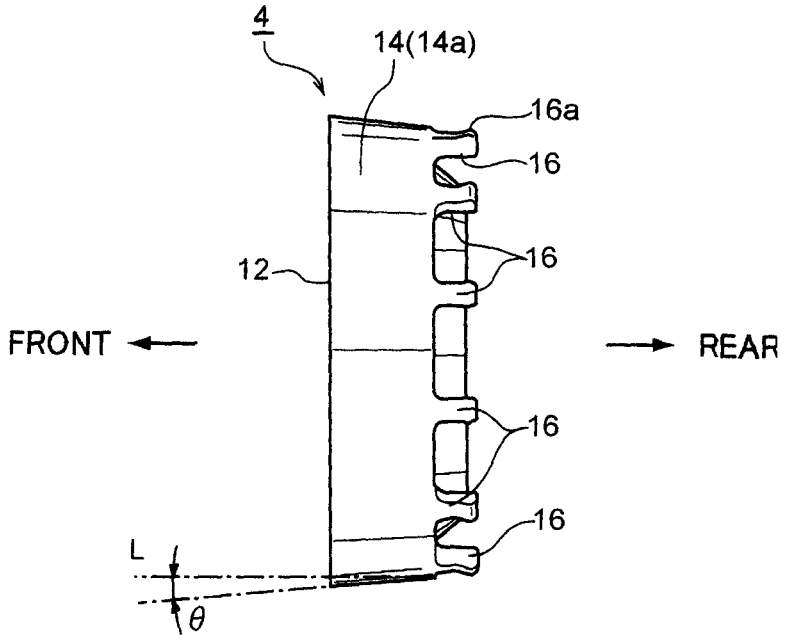
FIG. 5 is a side elevation of the functional member shown in FIG. 3.
Figure 6:
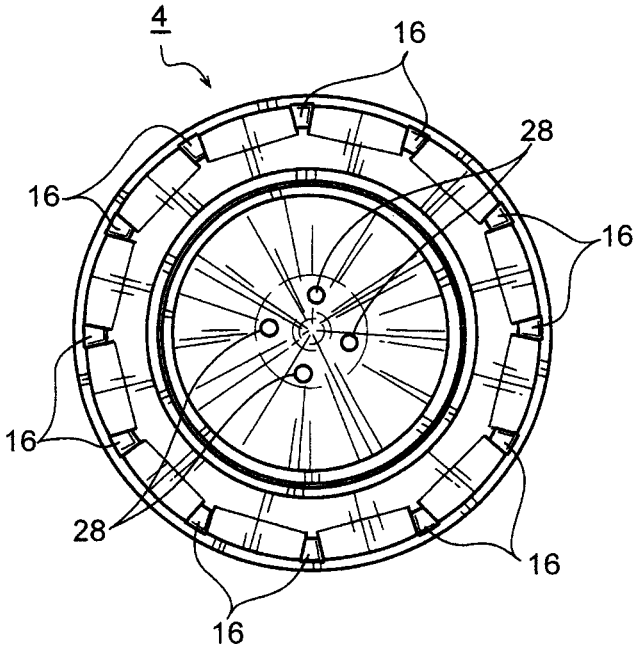
FIG. 6 is a rear elevation of the functional member shown in FIG. 3.

FIGS. 3 to 6 illustrate the functional member 4. FIG. 3 is its cross-sectional view, FIG. 4 is its front elevation, FIG. 5 is its side elevation, and FIG. 6 is its rear elevation. The functional member 4 is a relatively hard member formed by molding a synthetic resin such as PEEK (polyether ether ketone) for example.

The functional member 4 has a disc-shaped front wall 12 in its front elevation (FIG. 4). The front wall 12 has the function of the conventional hub member. The functional member 4 further has a sidewall 14 (FIG. 3) extending rearward from the outer circumferential portion of the front wall 12. The sidewall 14 is contiguous in the circumferential direction. The sidewall 14 includes an outer circumferential surface 14*a* and inner circumferential surface 14*b*. The outer circumferential surface 14*a* is shaped complementary with the peripheral wall 8 of the central recess 6 of the atomizer head body 2. The outer circumferential surface 14*a* of the sidewall 14 has a form that is generally cylindrical but gradually increases its diameter forward. That is, the outer circumferential surface 14*a* of the functional member 4 has a larger diameter at the front end thereof than at the rear end. This diameter is substantially equal to that of a corresponding portion of the central recess 6.

The functional member 4 has a plurality of legs 16 extending rearward from the outer circumferential portion of the rear end and disposed circumferentially at regular intervals as seen from FIG. 6. Each of the legs 16 has a claw 16*a* formed at the rear end or free end thereof to extend radially outward. Since the legs 16 are elastically deformable, the functional member 4 to be attached in the central recess 6 of the atomizer head body 2 can be inserted from the front end of the central recess 6. When the functional member 4 is set in place, the claws 16*a* of the legs 16 enter the circumferential groove 18 (FIG. 2) formed at the rear end of the peripheral wall of the central recess 6 and are engaged on the sidewall of the circumferential groove 18. Thus, the functional member 4 is removably fixed inside the atomizer head body 2 (FIG. 1).

At the bottom, which is the rear end of the functional member 4, a circumferential projection 20 is formed to project circumferentially inward of the legs 16 adjacently thereto to extend continuously in the circumferential direction. In association with the circumferential projection 20, a circumferential seat 22 is formed to rise continuously in the circumferential direction around the circular through-hole 10 in cross section on the bottom of the central recess 6 of the atomizer head body 2. When the circumferential projection 20 of the functional member 4 is seated on the outer circumferential portion of the circumferential seat 22, it abuts the outer circumferential surface of the circumferential seat 22 (FIG. 1).

As such, by employing the structure at the rear end of the functional member 4, in which the circumferential projection 20 located inside the legs 16 is seated onto the circumferential seat 22 of the atomizer head body 2 and brought into abutment with the outer circumferential surface of the circumferential seat 22, it is possible to hold the functional member 4 with an enhanced rigidity to the fixing structure of the functional member 4, which is the combination of the legs (16) and circumferential groove 18.

In the outer circumferential portion of the front wall 12, the functional member 4 has a plurality of paint outlets 24 formed at regular intervals on a common circle as seen from FIG. 4. Further, the front wall 12 has formed in the central portion thereof a dividing peak 26 projecting rearward like in the conventional atomizer head (FIG. 3). Four cleaning holes 28 are formed at regular intervals on a circle about the dividing peak 26 (FIG. 4).

Regarding the sidewall 14 of the functional member 4, the inner circumferential surface 14*b* opening rearward is an inclined wall gradually increasing its diameter forward. The paint outlets 24 are formed contiguous to the front end of the inner circumferential surface 14*b*. That is, the paint outlets 24 are contiguous to the inner circumferential surface 14*b* of the sidewall of the functional member 4. Most preferably, the axes of the paint outlets 24 incline in the same direction in which the inner circumferential surface 14*b* of the sidewall 14 inclines (FIGS. 1 and 3).

The circumferential seat 22 of the atomizer head body 2 preferably has a spoon-cut groove 30 formed in a forward-oriented surface, namely, in a surface opposite from the front wall 12 of the functional member 4 to extend circumferentially continuous, coaxially with the circular through-hole 10. The spoon-cut groove 30 has an outer circumferential wall surface 30*a* (FIG. 2) contiguous to the rear end of the inner circumferential surface 14*b* of the sidewall 14 of the functional member 4 and inclined by approximately the same angle of inclination as that of the inner circumferential surface 14*b* such that the outer circumferential wall surface 30*a* is flush with the inner circumferential surface 14*b* of the sidewall 14 (FIG. 1).

Most preferably, the end face at the outer circumferential side, namely, a top face 32, of the circumferential seat 22 having the spoon-cut groove 30 formed therein has a ridge-and-furrow configuration defined by a step 34 resulted from cutting a part facing to the spoon-cut groove 30 (FIG. 2), whereas the circumferential projection 20 of the functional member 4 has a ridge-and-furrow portion 36 formed at the inner circumferential side of the free end face thereof (FIG. 3). The ridge-and-furrow portion 36 of the circumferential projection 20 of the functional member 4 has a shape complementary with the ridge-and-furrow configuration of the outer circumferential-side top face 32 of the circumferential seat 22. Therefore, when the functional member 4 should be attached to the atomizer head body 2, it can be positioned in place reliably and easily by the ridge-and-furrow mating.

Furthermore, when the outer circumferential-side top face 32 of the circumferential seat 22 is fitted in the ridge-and-furrow portion 36 in the free end of the circumferential projection 20 of the functional member 4, the inner circumferential surface 14*b* of the sidewall 14 of the functional member 4 is flush with the outer circumferential wall surface 30*a* of the spoon-cut groove 30 in the circumferential seat 22. This flush engagement can prevent paint from entering between the sidewall 14 of the functional member 4 and the circumferential seat 22 of the atomizer head body 2.

As understood from FIG. 1, no sealing member (O-ring) is provided between the atomizer head body 2 and the functional member 4 fitted in the atomizer head body 2 by getting access to the central recess 6 from the front face of the atomizer head body 2. Instead, the outer circumferential surface 14*a* of the functional member 4 is held substantially in contact, along the entire length thereof, with the peripheral wall 8 of the central recess 6. Further, the peripheral wall 8 is an inclined wall enlarging forward in diameter. In addition, the paint outlets 24 are formed in the outer circumferential portion of the front wall 12 of the functional member 4.

It will be needless to say that, owing to the above-mentioned structure, paint having flown out from the paint outlets 24 is centrifugally driven to flow out radially along the outer circumferential edge of the front wall 12 of the functional member 4 and then it is ejected from the outer circumferential edge 2*c* along the inner circumferential surface 2*b* of the atomizer head body 2. However, since the outer circumferential surface 14*a* of the functional member 4 is substantially in contact, throughout the entire length thereof, with the peripheral wall 8 of the central recess 6, paint is not likely to enter between the functional member 4 and central recess 6. More specifically, even if paint enters there, it tends to be centrifugally ejected forward because the peripheral wall 8 of the central recess 6 is an inclined wall expanded forward in diameter. Therefore, it is possible to prevent paint from flowing around to between the hub body and central recess 6 in the atomizer head body 2 in which the hub body is received.

When the rotary atomizer head 1 needs to be cleaned by washing for using paint of another color, a cleaning liquid (typically a thinner) is supplied to the rotary atomizer head 1 as previously described. As indicated with dash lines in FIG. 3, the thinner flows in a space defined by the continuous sidewall 14 of the functional member 4 to wash the functional member 4 and the circumferential seat 22 of the atomizer head body 2, and it is ejected out through the cleaning holes 28 and paint outlets 24 to clean the front surface of the front wall 12 of the functional member 4 and the inner circumferential surface 2*b* of the atomizer head body.

In the first embodiment, the paint space S in the rotary atomizer head 1, in which paint supplied from the paint feed tube is received, is defined by the functional member 4 and atomizer head body 2. In the paint space S surrounded by the functional member 4 (see FIG. 1), the wall surrounding the paint space S is formed from continuous smooth surfaces flush with each other. In other words, the wall surface of the paint space S is free from steps or the like to which paint is likely to stick. Therefore, it is possible to prevent paint from staying on and sticking to the surfaces defining the paint space S and wash the entire area of the paint space S with a cleaning liquid efficiently with no residual paint.

With reference to FIG. 1 again, the depth of the central recess 6 of the atomizer head body 2 and thickness of the functional member 4 are preferably determined such that a step 40 is produced between the front wall 12 of the functional member 4 and inner circumferential surface 2*b* of the atomizer head body 2 when the functional member 4 is attached to the atomizer head body 2. As described in the foregoing, the peripheral wall 8 of the central recess 6 forms an angle of θ with the axis of rotation of the rotary atomizer head 1. Since this angle θ is as small as can be approximately regarded as zero, the step 40 is formed from a wall erected generally at right angle with respect to the front of the front wall 12 of the functional member 4.

The step 40 is called as a dam hereunder. Paint supplied from the feed tube (not shown) flows out of the paint outlets 24 formed in the outer circumferential portion of the front wall 12 and spreads in the radially outward direction. However, this paint is once banked up by the dam (step 40) before moving further. That is, it has been proved by the Inventors' experiments that the step 40 could surely function as a dam and air bubbles in the paint be removed due to the dam function of the step 40. In other words, the object coated using the rotary atomizer head 1 having the above-mentioned step 40 exhibited a paintwork that was free from bubbles and had excellent smoothness.

Other embodiments of the present invention will be explained hereunder with reference to FIG. 7 and subsequent drawings. In explanation of these embodiments, the same elements as those in the first embodiment are labeled with the same reference numerals to omit their explanation.

Second Embodiment

Figure 7:
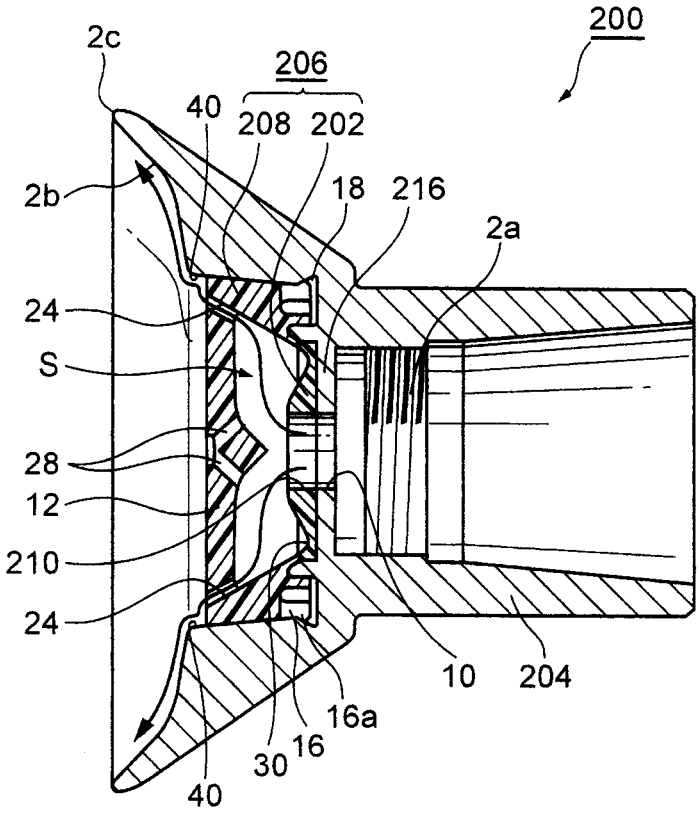
FIG. 7 is a cross-sectional view of a rotary atomizer head according to a second embodiment of the present invention, which corresponds to FIG. 1 showing the first embodiment.
Figure 8:
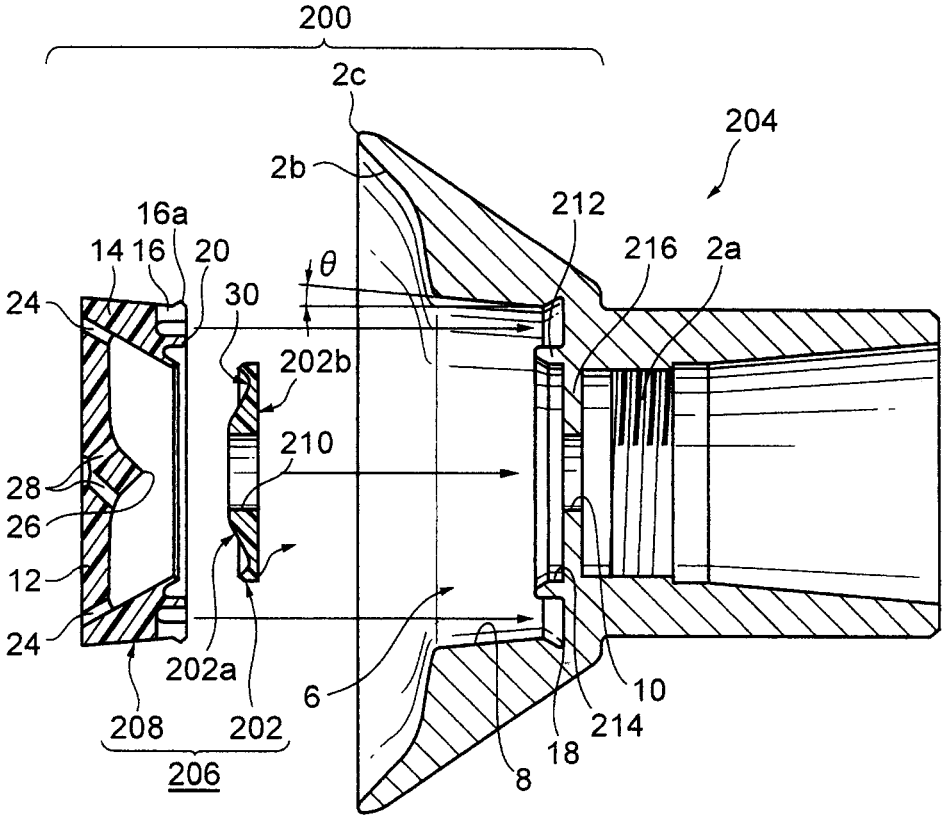
FIG. 8 is an exploded cross-sectional view of the rotary atomizer head according to the second embodiment.

FIGS. 7 and 8

The first embodiment has been explained as providing the spoon-cut groove 30 in the atomizer head body 2. In the second embodiment, a rotary atomizer head 200 additionally includes a synthetic resin-made bottom member 202, and the spoon-cut groove 30 is formed in this bottom member 202. According to the second embodiment, the paint space S in the rotary atomizer head 200 is defined by two functional members 208 and 202.

The second embodiment is explained here in greater detail with reference to FIG. 8. The rotary atomizer head 200 includes an atomizer head body 204 and a functional member 206 that is assembled in the atomizer head body 204. The functional member 206 includes the first functional member 208 and the bottom member 202 additionally provided separately from the first functional member 208. The first functional member 208 and the bottom member 202 may be moldings formed from the same synthetic resin material or from different synthetic resin materials respectively. Typically, the first functional member 208 and the bottom member 202 are moldings formed from a synthetic resin such as PEEK (polyether ether ketone).

As seen from FIG. 8, the bottom member 202 is formed like a disc and has the spoon-cut groove 30 formed in a front surface 202*a* thereof. The other surface of the bottom member 202, that is, a rear surface 202*b*, is flat. The bottom member 202 has formed in the center thereof a circular opening (through-hole) 210 that extends longitudinally of the bottom member 202 and communicates with the through-hole 10 in the atomizer head body 204.

The first functional member 208 is designed substantially equal to the functional member 4 in the first embodiment. Therefore, the same elements as those of the functional member 4 in the first embodiment are labeled with the same reference numerals as those used in the explanation of the first embodiment to omit their explanation.

As seen in FIG. 8, the atomizer head body 204 has an annular circumferential ridge 212 on the bottom of the central recess 8. The atomizer head body 204 has an additional furrow 214 formed in the inner circumferential portion of the annular circumferential ridge 212. This additional furrow 214 has a shape complementary with that of the additional functional member, that is, the bottom member 202. The bottom member 202 is received in and held in position by the additional furrow 214.

As shown in FIG. 8, the rotary atomizer head 200 is completed by assembling the additional functional member, that is, bottom member 202 first, and then the first functional member 208, to the atomizer head body 204. Thus, the first functional member 208 and the additional functional member, i.e. the bottom member 202, define the paint space S.

That is, in the rotary atomizer head 200 according to the second embodiment, the paint space S to receive paint supplied from the paint feed tube is defined by the first functional member 208 and additional functional member 202 both formed by molding a synthetic resin material. The first functional member 208 and the additional functional member 202 are removable from the atomizer head body 204.

As best shown in FIG. 7, the first functional member 208 is fitted on the circumferential ridge 212 and positioned in place by the latter. In the complete rotary atomizer head 200, the paint space S defined by the first functional member 208 and the bottom member 202 has an inner circumferential surface having no clearance and unevenness.

In the rotary atomizer head 200 according to the second embodiment, since the bottom of the central recess 6 in the atomizer head body 204 is designed simpler than in the rotary atomizer head according to the first embodiment, the atomizer head body 204 can be produced with less costs. Of course, also in the rotary atomizer head 200 according to the second embodiment, the paint space S can be cleaned while keeping the first functional member 208 and the bottom member 202 in assemblage in the atomizer head body 204. Further, the atomizer head body 204, first functional member 208 and bottom member 202 can be individually washed and reused by removing the first functional member 208 and the bottom member 202 from the atomizer head body 204. Further, since the first functional member 208 and the bottom member 202, which is the additional functional member, are separate elements, they may be made of different synthetic resin materials. For example, the first functional member 208 may be made of PEEK (polyether ether ketone) resin, whereas the bottom member 202 may be made of a fluoroethylene resin (typically Teflon (registered trademark)), which is excellent in washability.

Third Embodiment

Figure 9:
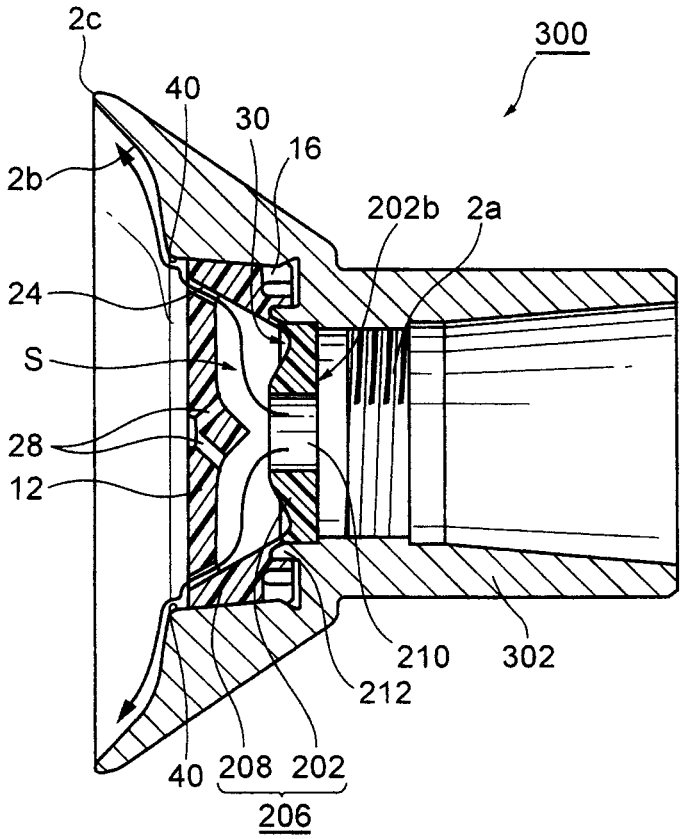
FIG. 9 is a cross-sectional view of a rotary atomizer head according to a third embodiment of the present invention, which corresponds to FIG. 1 showing the first embodiment.
Figure 10:
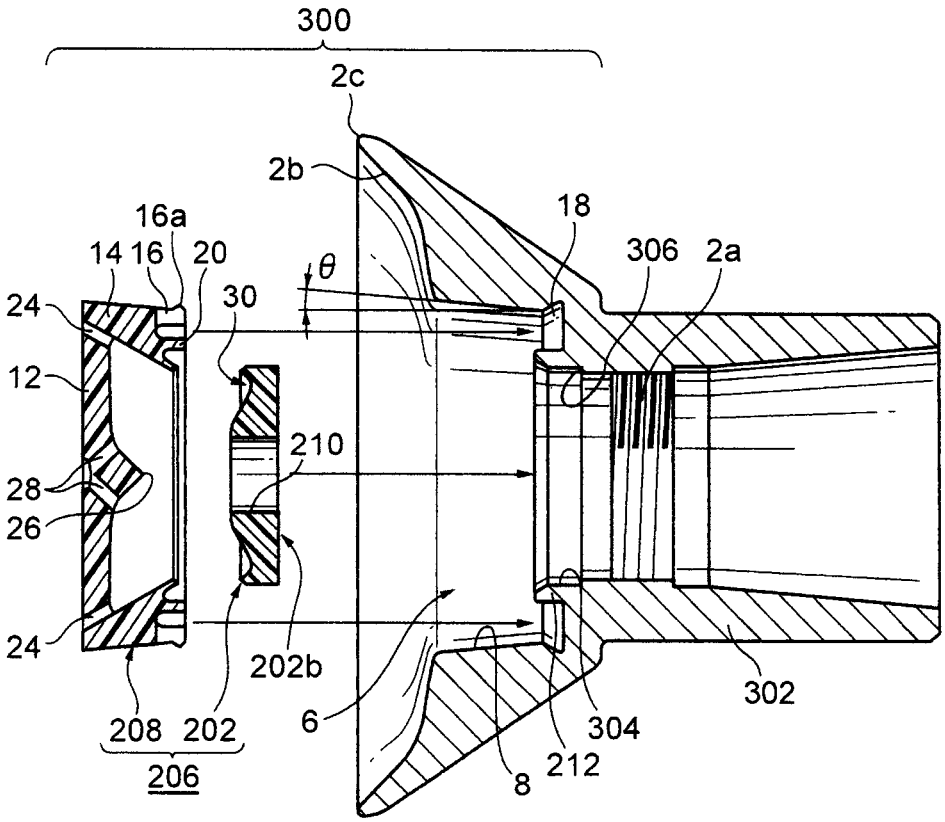
FIG. 10 is an exploded cross-sectional view of the rotary atomizer head according to the third embodiment.

FIGS. 9 and 10

The third embodiment is a rotary atomizer head 300 that is a variant of the second embodiment (FIGS. 7 and 8) as well. The rotary atomizer head 300 according to the third embodiment has no bulkhead 216. The rotary atomizer head 300 includes an atomizer head body 302 having a large-diameter portion 304 in which the bottom member 202 is received. The rear end of this large-diameter portion 304 is defined by a step 306. When attached to the large-diameter portion 304 of the atomizer head body 302, the bottom member 202 is engaged on the step 306. In this fashion, the bottom member (spoon-cut) 202 is positioned in place.

Fourth Embodiment

Figure 11:
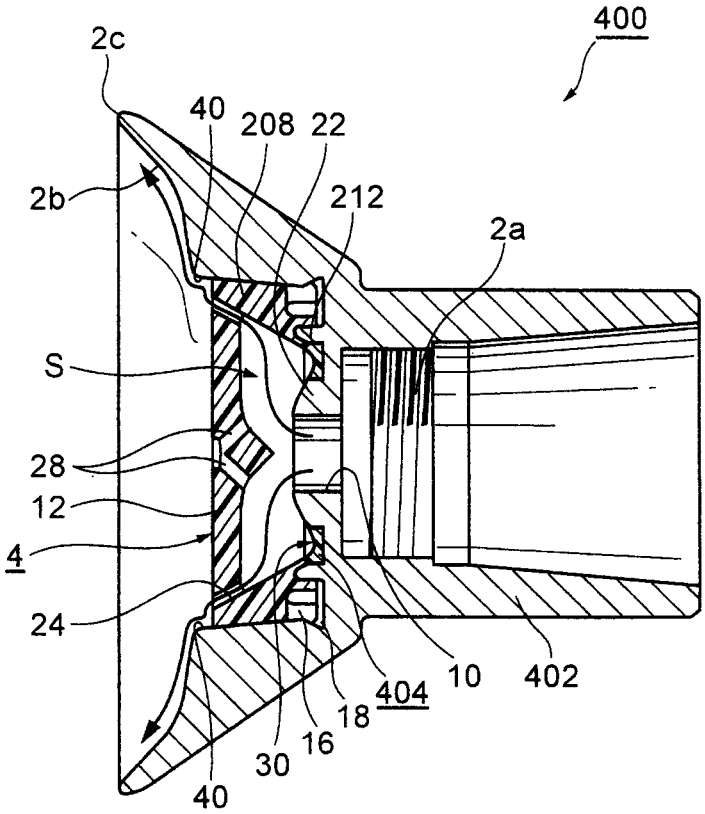
FIG. 11 is a cross-sectional view of a rotary atomizer head according to a fourth embodiment of the present invention, which corresponds to FIG. 1 showing the first embodiment.
Figure 12:
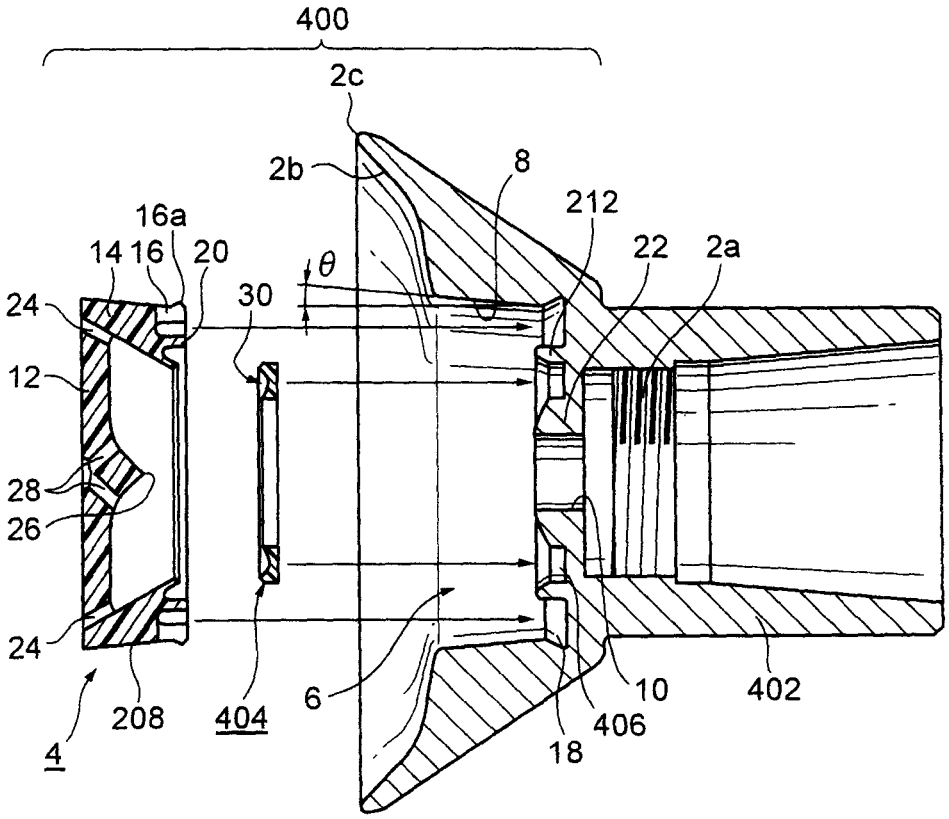
FIG. 12 is an exploded cross-sectional view of the rotary atomizer head according to the fourth embodiment.

FIGS. 11 and 12

The fourth embodiment is a variant of the first embodiment (FIG. 1) as well. The fourth embodiment is a rotary atomizer head 400 having an atomizer head body 402 in which the deep portion of the spoon-cut groove 30 formed in the atomizer head body 2 in the first embodiment is made of a synthetic resin (spoon-cut member 404). This spoon-cut member 404 is an additional functional member. The spoon-cut member 404 is an annular molding. In the atomizer head body 402, a circumferential furrow 406 having a shape complementary with the spoon-cut member 404 is formed adjacent to, and at the inner circumferential side of, the circumferential ridge 212 of the circumferential seat 22. When received in the circumferential furrow 406, the spoon-cut member 404 is positioned in place. The outer circumferential edge of the spoon-cut member 404 held in position is contiguous to the first functional member 4 with no unevenness.

More specifically, in the rotary atomizer head 400 according to the fourth embodiment, the paint space S to receive paint supplied from the paint feed tube is defined by the first functional member 4, spoon-cut member 404 and atomizer head body 402. Also in this fourth embodiment, the paint space S has an inner wall free from clearance and step.

Also in the fourth embodiment, of course, since the first functional member 4 and the spoon-cut member 404, which is an additional functional member, are separate elements from the first functional member 4, they may be made of the same synthetic resin or different resin materials, respectively.

Fifth Embodiment

Figure 13:
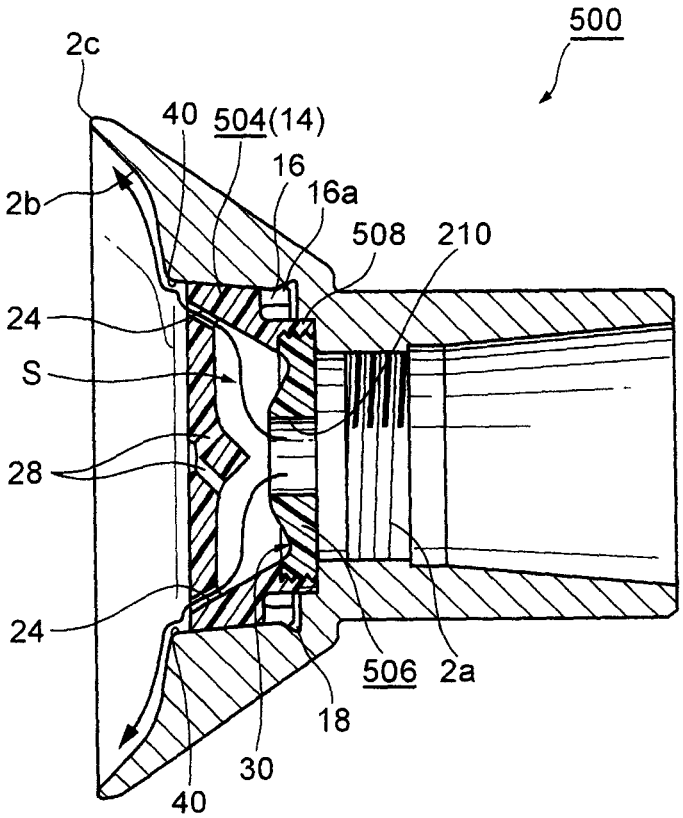
FIG. 13 is a cross-sectional view of a rotary atomizer head according to a fifth embodiment of the present invention, which corresponds to FIG. 1 showing the first embodiment.
Figure 14:
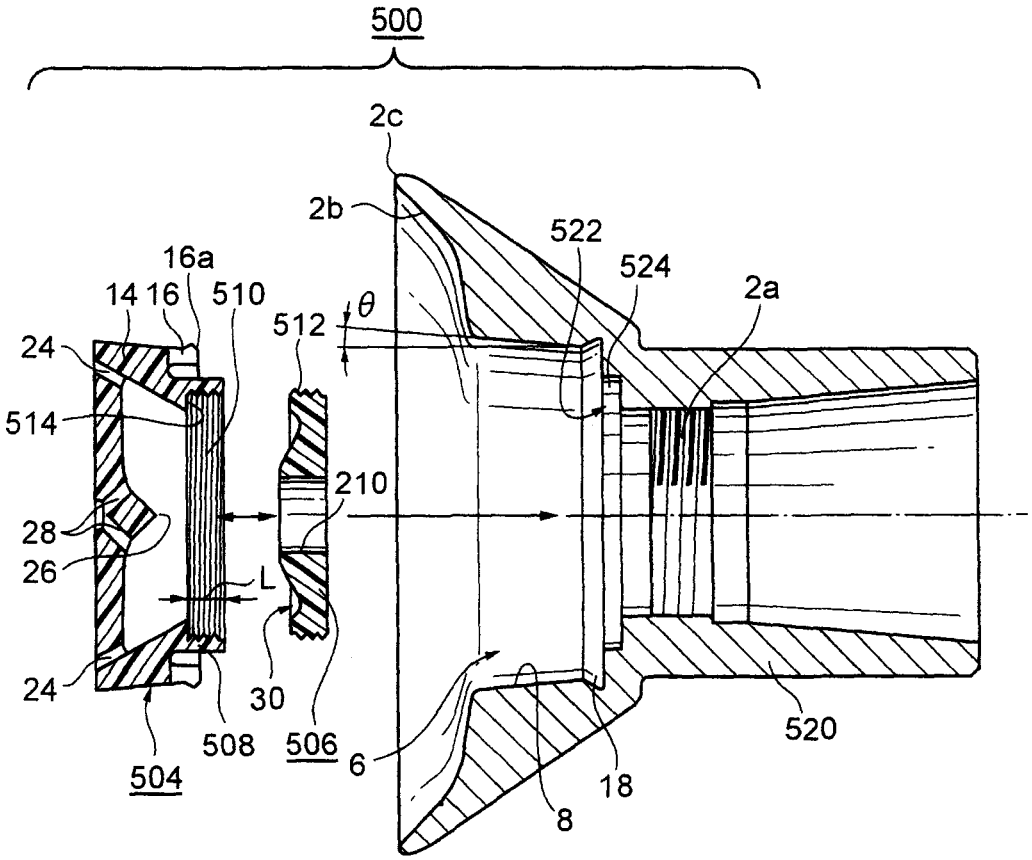
FIG. 14 is an exploded cross-sectional view of the rotary atomizer head according to the fifth embodiment, in which the functional member is shown exploded.
Figure 15:
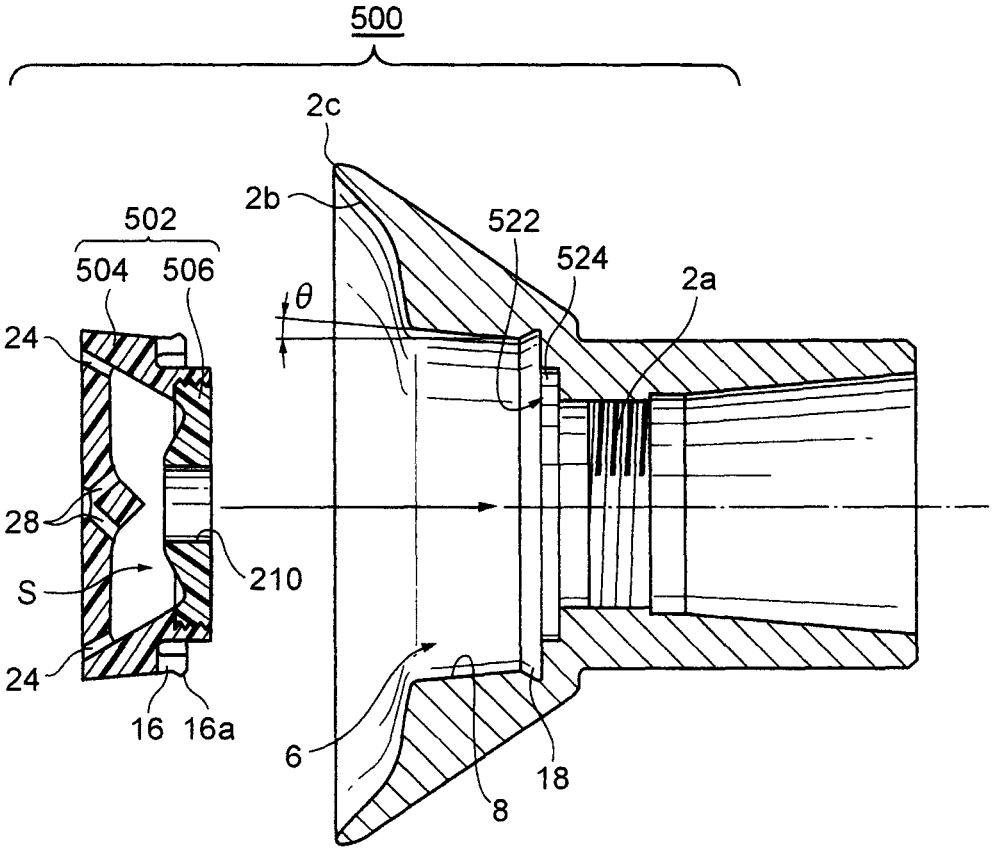
FIG. 15 is a cross-sectional view of the rotary atomizer head according to the fifth embodiment, in which the rotary atomizer head is exploded to the atomizer head body and the functional member.

FIGS. 13 to 15

The fifth embodiment is a rotary atomizer head 500 having a functional member 502 consisting of a first functional member 504 and an additional functional member 506. It is common to the fifth embodiment and previously explained first second to fourth embodiments that the first functional member 504 and additional functional member 506 are formed independently of each other. However, the first functional member 504 and additional functional member 506 in the fifth embodiment are united with each other by screwing unlike those in the first to fourth embodiments.

Basically, the first functional member 504 is equivalent to the first functional member 208 of the rotary atomizer head 200 according to the second embodiment, but it is different from the rotary atomizer head 200 (first functional member 208) in that a rearward extending cylindrical portion 508 is provided at the inner circumferential side of the legs 16. The cylindrical portion 508 is threaded in the inner circumferential surface thereof to make a first threaded portion 510.

The additional functional member 506 included in the fifth embodiment includes basically the same configuration as those of the additional functional members, i.e. bottom members 202, of the second and third embodiments. However, the additional functional member 506 used in the fifth embodiment is different from the additional functional member (bottom member 202) used in the second and third embodiments in that the additional functional member included in the fifth embodiment, i.e., the bottom member 506, is threaded in the outer circumference thereof to make a second threaded portion 512. By screwing the second threaded portion 512 into the first threaded portion 510, the first functional member 504 and additional functional member 506 are separably coupled with each other.

The cylindrical portion 508 of the first functional member 504 included in the fifth embodiment has a step 514 on the inner circumferential portion thereof, and the distance L from the step 514 to the rear end of the cylindrical portion 508 is equal to the thickness of the outer circumferential portion of the additional functional member, that is, bottom member 506. When the additional functional member (bottom member 506) is screwed to the first functional member 504, the outer circumferential portion of the bottom member 506 is engaged at the front end face thereof on the step 514 of the first functional member 504 (FIG. 14). In this state, the cylindrical portion 508 of the first functional member 504 is flush at the rear end face thereof with the rear end face of the additional functional member 506.

The rotary atomizer head 500 according to the fifth embodiment includes an atomizer head body 520. The atomizer head body 520 has an additional cylindrical indentation 522, which is open forward (FIG. 14), formed in a deep portion of the central recess 6. The cylindrical indentation 522 is defined by a step 524 (FIGS. 14 and 15). The functional member 502 included in this fifth embodiment is received in the cylindrical indentation 522, and the step 524 is engaged partially on the rear end of the first functional member 504 and rear end of the additional functional member 506. In this fashion, the functional member 502 is positioned in place.

In the rotary atomizer head 500 according to the fifth embodiment, the paint space S to receive paint supplied from the paint feed tube is defined by the first and additional functional members 502 and 506 both made of a synthetic resin. The paint space S has a smooth inner wall that has no gap and no unevenness. When a user wants to clean the rotary atomizer head 500 by disassembling it, the user may remove the functional member 502 from the atomizer head body 520 and next disassemble the functional member 502 to separate the first functional member 504 and the additional functional member 506. In this state, he can perform the intended cleaning The first functional member 504 and the additional functional member 506 and may be made of the same synthetic resin or different resin materials, respectively.

Heretofore, the first to fifth embodiments of the present invention have been explained. It should be noted however that the step 40 included in these embodiments and having the dam function may of course be formed by a functional member. For example, in the functional member 4 included in the rotary atomizer head 1 according to the first embodiment (FIGS. 1 to 6), the cylindrical portion extending forward at the outer circumferential portion of the front wall 12 may be formed integrally to provide the step 40.

The present invention is suitable for application to rotary atomization type electrostatic paint applicators.

What is claimed is:

1. A rotary atomizer head for an electrostatic paint applicator, having a paint space for receiving paint supplied from a paint feed tube and a spoon-cut groove formed in the bottom surface of the paint space, comprising:

a bell-shaped atomizer head body, and a functional member made of a synthetic resin, which is accessible from a front face of the atomizer head body into a central recess of the atomizer head body, the functional member being removably disposed in the central recess of the atomizer head body, wherein the functional member includes: a front wall defining the paint space between the spoon-cut groove and the front wall, and having a dividing peak projecting rearward from the central portion of the front wall and cleaning holes formed around the dividing peak; a sidewall of the paint space extending continuously in a circumferential direction and having an inner circumferential surface of the side wall that is an inclined wall gradually increasing its diameter forward; a plurality of legs extending rearward from a rear end of the sidewall in circumferential alignment at intervals from each other; and a claw extending radially outward from each leg, the claw being provided at a free end of each leg to engage with a circumferential groove formed in a peripheral wall of the central recess of the atomizer head body;

wherein the peripheral wall of the central recess of the atomizer head body gradually increases forward in diameter by an angle of inclination;

wherein the circumferentially continuous sidewall of the functional member has an outer circumferential surface having a complementary configuration with the peripheral wall of the central recess, and the outer circumferential surface of the sidewall of the functional member is in contact with the peripheral wall of the central recess, and wherein the outer circumferential surface of the sidewall has a form that is generally cylindrical and gradually increases its diameter forward;

wherein the circumferentially continuous sidewall of the functional member has an inner circumferential surface contiguous to the spoon-cut groove;

wherein the front wall of the functional member has a plurality of paint outlets formed at circumferential intervals to communicate with the paint space; and wherein the paint outlets are contiguous to the inner circumferential surface of the sidewall of the functional member and have axes that incline in the same direction as the inner surface of the side wall.

2. The rotary atomizer head according to claim 1, wherein the functional member includes a first functional member made of a synthetic resin, which has said sidewall and said plurality of legs, and an additional functional member made of a synthetic resin to include at least said spoon-cut groove, and wherein said atomizer head body has a circumferential recess formed in the bottom of the central recess to receive the additional functional member therein.

3. The rotary atomizer head according to claim 1, wherein the functional member includes: a first functional member made of a synthetic resin to have said sidewall and said plurality of legs; and an additional functional member made of a synthetic resin to define the paint space in cooperation with the first functional member and to define the bottom of the paint space.

4. The rotary atomizer head according to claim 3, wherein the additional functional member is separably coupled to the first functional member.

5. The rotary atomizer head according to claim 4, wherein the rear surface of the additional functional member is flat;

wherein the atomizer head body has a recess formed therein to receive the additional functional member therein; and wherein the recess has a step formed thereon to engage with the rear surface of the additional functional member.

6. The rotary atomizer head according to claim 1, wherein a step having a dam function is formed between the functional member and the atomizer head body when the functional member is attached to the atomizer head body.

7. The rotary atomizer head according to claim 3, wherein a step having a dam function is formed between the functional member and the atomizer head body when the functional member is attached to the atomizer head body.

8. The rotary atomizer head according to claim 1, wherein the functional member has a step formed on the outer circumference of the front end of the functional member to provide a dam mechanism receiving and spreading paint which has flown out of the plurality of paint outlets.

9. The rotary atomizer head according to claim 3, wherein the functional member has a step formed on the outer circumference of the front end of the functional member to provide a dam mechanism receiving and spreading paint which has flown out of the plurality of paint outlets.

10. The rotary atomizer head according to claim 1, wherein the functional member further comprises a circumferential projection which projects circumferentially inward of the legs adjacently thereto, wherein the circumferential projection extends continuously in a circumferential direction around a through-hole on a bottom of the central recess of the atomizer head body, and wherein the circumferential projection sits on and gets in abutment with an outer circumferential portion of a circumferential seat of the atomizer head body.

11. The rotary atomizer head according to claim 1, wherein the outer circumferential surface of the functional member has a larger diameter at a front end thereof than at the rear end thereof, and wherein the outer circumferential surface of the functional member has complementary inclination with that of the peripheral wall.

* * * * *